United States Patent [19]

Pang

[11] 4,000,481

[45] Dec. 28, 1976

[54] MAGNETIC LATCH WITH SHUNT PATH BARREL

[75] Inventor: Peter Pang, Hong Kong, Hong Kong

[73] Assignee: I-T-E Imperial Corporation, Spring House, Pa.

[22] Filed: Feb. 9, 1976

[21] Appl. No.: 656,107

[52] U.S. Cl. ..... 335/170; 335/174

[51] Int. Cl.[2] ..... H01H 9/20

[58] Field of Search ..... 335/229, 230, 234, 253, 335/254, 170, 174, 175

[56] References Cited

UNITED STATES PATENTS

| | | | |
|---|---|---|---|
| 3,022,450 | 2/1962 | Chase | 335/253 X |
| 3,683,239 | 8/1972 | Sturman | 335/170 X |
| 3,783,423 | 1/1974 | Mater et al. | 335/229 X |
| 3,792,390 | 2/1974 | Boyd | 335/234 X |
| 3,886,507 | 5/1975 | Johnston et al. | 335/254 X |

*Primary Examiner*—George Harris

[57] ABSTRACT

An electrically releasable permanent magnet latch includes a magnetic tube disposed within a U-shaped magnetic form. Disposed within the tube are a lightweight armature and a coil spring biasing the armature forward. An electromagnet coil is wound about the rear portion of the tube and a pair of permanent magnets are inside the frame along side the front portions of the tube. Energization of the coil creates a flux which bucks the permanent magnet flux to permit the spring to overcome the armature holding force whereby the spring operates the armature.

10 Claims, 3 Drawing Figures

FIG. 2
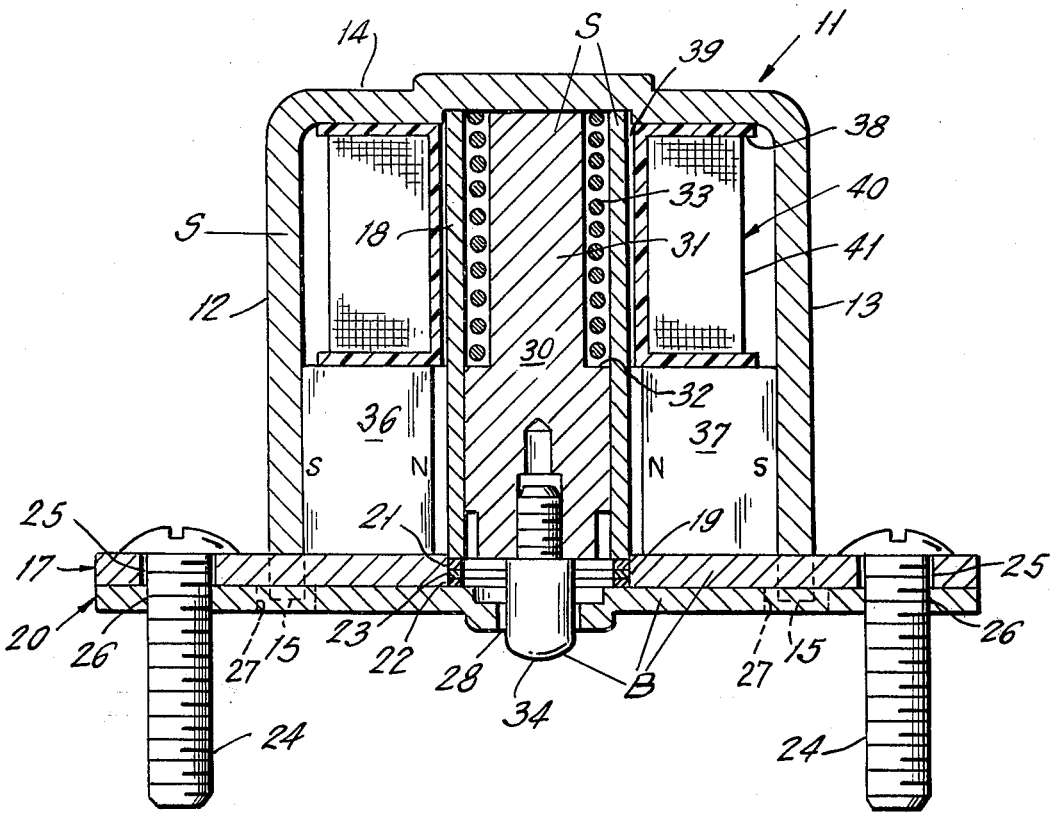
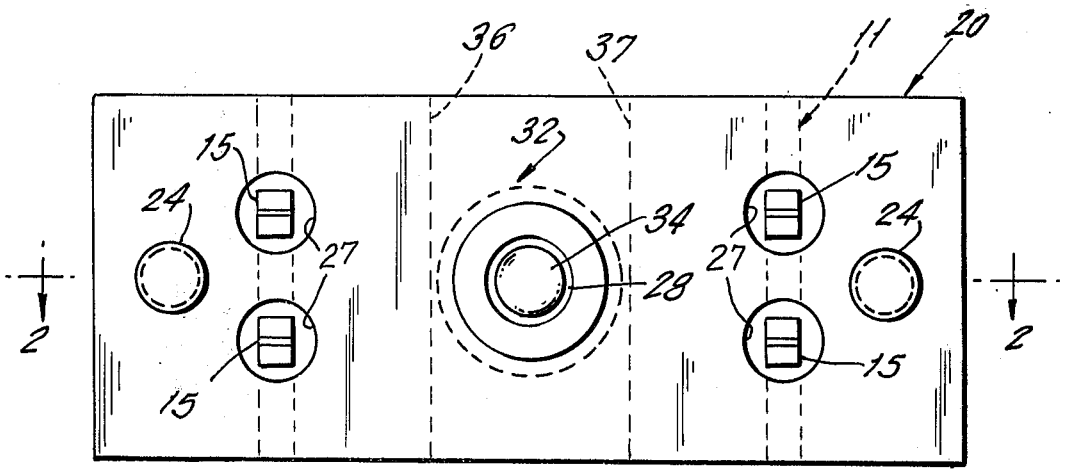
FIG. 1

14
11
12
13
15
15
38
40
41
36
33
37
31
S
N
18
N
S
32
30
34
21
23
24
22
24
17
16
19
25
25
16
20
27
26
27
26
28

MAGNETIC LATCH WITH SHUNT PATH BARREL

This invention relates generally to compact magnetic latches and more particularly relates to latches of this type that are released by electromagnetic means.

In many electromagnetic devices, permanent magnets are often used to hold working elements in normal or latched positions against forces generated by biasing springs so that no electrical energy is required to maintain the latched condition. Latch release is obtained by generating a flux field electromagnetically over a short time interval. This electrically generated flux field opposes the permanent magnetic field to the extent that the force of the net field is less than the spring force so that the latter is effective to release the latch and cause operation of a utilization device, such as a trip mechanism of a circuit breaker as described in U.S. Pat. No. 3,783,423 issued Jan. 1, 1974 to A. E. Mater and A. Wafer for Circuit Breaker With Improved Flux Transfer Magnetic Actuator.

In accordance with the instant invention a compact magnetic latch requiring low actuating power is constructed by mounting a lightweight movable armature within a magnetic tube or barrel. A biasing spring mounted within the tube urges the armature toward one end of the tube so that an armature extension will project from the tube and engage a utilization device. One portion of the tube is surrounded by the coil of an electromagnet, and magnets are positioned adjacent the tube at diametrically opposite points thereof. The tube, coil and magnets are disposed within a U-shaped magnetic frame with the tube axis extending parallel to the arms of the frames and positioned midway therebetween.

Normally, the armature is held in a retracted position by the force of the magnetic flux field generated by the permanent magnets. Energization of the coil generates flux in opposition to the permanent magnet flux whereby the force of the net flux acting on the armature is insufficient to maintain the armature holding force above the spring force acting in opposition thereto. Thus, the spring is now effective to move the armature so that its extension projects beyond the barrel and actuates a utilization device.

Accordingly, a primary object of the instant invention is to provide a novel construction for a permanent magnet latch.

Another object is to provide a latch of this type that is of compact construction in relation to the spring force that is active when the latch is released.

Still another object is to provide a latch of this type having a relatively low mass armature.

A further object is to provide a latch of this type in which the armature is protected against contamination by being disposed within a permeable tube.

A still further object is to provide a latch of this type which permits utilization of relatively large permanent magnets without saturating the armature.

These objects as well as other objects of this invention shall become readily apparent after reading the following description of the accompanying drawings in which:

FIG. 1 is a front elevation of a magnetic latch constructed in accordance with teachings of the instant invention.

FIG. 2 is a cross section taken through line 2,2 of FIG. 1 looking in a direction of arrows 2,2.

Figure 3:
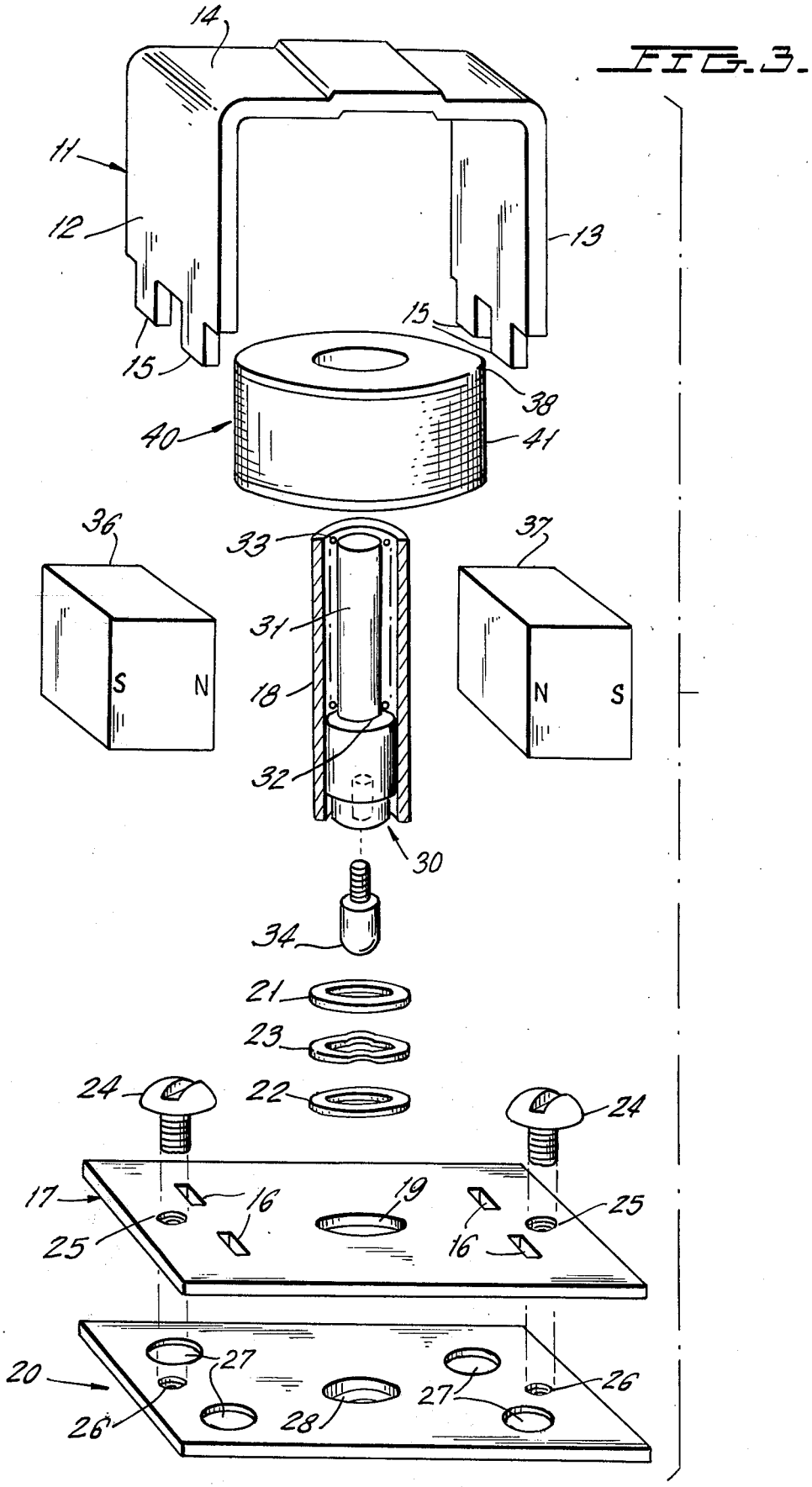
FIG. 3 is an exploded perspective of the latch of FIG. 1.

Now referring to the figures. Permanent magnet latch assembly 10 includes U-shaped magnetic frame 11 having arms 12,13 connected at their rear ends by web 14. The front ends of arms 12,13 are provided with forwardly projecting tongues 15 that extend through rectangular apertures 16 of inner non-magnetic cover plate 17. Each of the tongues 15 is staked to mechanically secure frame 11 to plate 17. Cylindrical magnetic barrel or tube 18 is disposed within frame 11 with the longitudinal axis of the former being disposed parallel to arms 12,13 and midway therebetween.

The rear end of tube 18 abuts web 14 and the front end of tube 18 is aligned with circular aperture 19 of plate 17. Aperture 19 is of a diameter slightly larger than the outer diameter of tube 18 so as to permit insertion of the latter through the former. Disposed within aperture 19 are nonmagnetic flat washers 21,22 having wave or spring washer 23 disposed therebetween. Elements 21–23 are maintained in their operative positions by outer cover plate 20 which abuts the forward surface of plate 17 being secured in operative position by a pair of screws 24 extending through clearance apertures 25 of plate 17 and threadably received by apertures 26 of plate 20. Circular apertures 27 of plate 20 align with and provide clearances for tongues 15. Circular aperture 28 of plate 20 is aligned with aperture 19 but is of smaller diameter for a reason which will hereinafter be seen:

Disposed within tube 18 is cylindrical magnetic armature 30 whose main portion 31 is surrounded by coiled compression spring 33 also disposed within tube 18. The rear end of spring 33 bears against web 14 and the forward end of spring 33 bears against armature shoulder 32 to bias armature 30 in a forward direction. Reduced diameter extension 34 at the forward end of armature 30 projects through aperture 28.

Bar shaped permanent magnets 36,37 are disposed within frame 11 at diametrically opposite locations at the forward ends of tube 18. The magnet poles are indicated as N,S and the magnetic axes which passes through the pole of each magnet are perpendicular to the cylindrical axis of tube 18. Tube 18 extends through central aperture 39 of non-magnetic bobbin 38 which forms part of coil assembly 40. The latter includes coil 41 which is wound on bobbin 38 and having its turns generally concentric with the outer surface of tube 18. Coil assembly 40 is disposed within frame 11 adjacent to web 14.

With coil 41 de-energized, the force of the flux field generated by magnets 36,37 is sufficient to hold armature 30 in the retracted position shown in FIG. 2 against the forwardly directed mechanical biasing force provided by spring 33. However, the force of magnets 36,37 is not sufficient to draw armature 30 to this normal position. A mechanical means (not shown) must move armature 30 to this normal position. To release armature 30 and project its extension 34 forward, coil 41 is energized. This generates a magnetic flux field in opposition to the flux field generated by magnets 36,37. The magnitude of the coil generated flux field results in a net magnetic field whose force acting on armature 30 is less than the force generated by spring 33, so that armature 30 is free to move forward under the influence of biasing spring 33, with this forward movement being limited by the engagement of armature 30 with the rear surface of plate 20.

Thus, it is seen that the instant invention provides a novel compact construction for a permanent magnet latch having a lightweight armature and requiring low power for latch release.

Although the present invention has been described in connection with a preferred embodiment thereof, many variations and modifications will now become apparent to those skilled in the art. It is preferred, therefore, that the present invention be limited not by the specific disclosure herein, but only by the appended claims. In these claims, the use of the term "magnetic" is meant to designate a material having high magnetic permeance, such as a ferro-magnetic material, and the term "non-magnetic" is meant to designate a material having low magnetic permeance, such as air or brass.

I claim:

1. A magnetic latch including a magnetic frame, a magnetic tube within said frame, a magnetic armature movable axially within said tube, biasing means disposed within said tube, and urging said armature in a first direction toward a first axial position near one end of said tube wherein an axial extension of said armature projects beyond said one end, permanent magnet means disposed within said frame and outside of said tube, and generating a flux field that normally holds said armature against force generated by said biasing means in a second axial position wherein said extension is retracted, coil means disposed within said frame and having said tube extending therethrough, said coil means, when energized generating magnetic flux in opposing the flux field of said permanent magnet to the extent that net flux is insufficient to hold the armature in said first axial position whereby the biasing means moves the armature to said first axial position for activation of an external device by said extension.

2. A magnetic latch as set forth in claim 1 in which the frame is U-shaped having first and second spaced arms connected at one end by a web, said tube having its other end adjacent said web and its axis generally parallel to said arms.

3. A magnetic latch as set forth in claim 2 in which the permanent magnet means includes first and second sections, said first section being interposed between said tube and said first arm, and said second section being interposed between said tube and said second arm.

4. A magnetic latch as set forth in claim 3 in which the magnetic axes of said sections are generally perpendicular to the axis of said tube.

5. A magnetic latch as set forth in claim 2 in which coil means is disposed between said web and said permanent magnet means.

6. A magnetic latch as set forth in claim 3 in which coil means is disposed between said web and said permanent magnet means.

7. A magnetic latch as set forth in claim 4 in which coil means is disposed between said web and said permanent magnet means.

8. A magnetic latch as set forth in claim 2 also including non-magnetic cover means connecting the other ends of the arms and providing means to limit movement of said armature in said first direction.

9. A magnetic latch as set forth in claim 8 in which coil means is disposed between said web and said permanent magnet means.

10. A magnetic latch as set forth in claim 9 in which the cover means includes an aperture through which the extension projects when said armature is in said first position.

* * * * *